US006764556B2

(12) United States Patent
Myojin et al.

(10) Patent No.: US 6,764,556 B2
(45) Date of Patent: Jul. 20, 2004

(54) COPPER-NICKEL-SILICON TWO PHASE QUENCH SUBSTRATE

(76) Inventors: Shinya Myojin, 1304 Battleway Ct., Myrtle Beach, SC (US) 29579; Richard L. Bye, 2 Edgehill Ave., Morristown, NJ (US) 07960; Nicholas J. Decristofaro, 33 Lincoln Ave., Chatham, NJ (US) 07928; Jeng S. Lin, 50 Alexandria Rd., Morristown, NJ (US) 07960; David W. Millure, 3720 Waterford Dr., Myrtle Beach, SC (US) 29577; Joseph G. Cox, Jr., 136 N. Second St., Lehighton, PA (US) 18235; Dale R. Walls, 1766 Landing Rd., Myrtle Beach, SC (US) 29577; Gary B. A. Schuster, 1820 Manchester Way, Myrtle Beach, SC (US) 29575

( * ) Notice: Subject to any disclaimer, the term of this patent is extended or adjusted under 35 U.S.C. 154(b) by 173 days.

(21) Appl. No.: 10/150,382

(22) Filed: May 17, 2002

(65) Prior Publication Data

US 2004/0112566 A1 Jun. 17, 2004

(51) Int. Cl.[7] ..... C22C 9/06

(52) U.S. Cl. ..... 148/435; 148/686; 420/485; 420/486; 420/487; 420/488

(58) Field of Search ..... 148/435, 686; 420/485, 486, 487, 488

(56) References Cited

U.S. PATENT DOCUMENTS

| | | | | |
|---|---|---|---|---|
| 4,142,571 A | | 3/1979 | Narasimhan | 164/88 |
| 4,260,435 A | | 4/1981 | Edens et al. | 148/32.5 |
| 4,537,239 A | | 8/1985 | Budzyn et al. | 164/423 |
| 4,818,307 A | * | 4/1989 | Mori et al. | 148/414 |
| 5,564,490 A | | 10/1996 | Liebermann et al. | 164/463 |
| 5,842,511 A | | 12/1998 | Raybould et al. | 164/423 |
| 5,846,346 A | | 12/1998 | Lee et al. | 148/433 |
| 6,251,199 B1 | | 6/2001 | Mandigo et al. | 148/433 |

FOREIGN PATENT DOCUMENTS

| | | | |
|---|---|---|---|
| EP | 0024506 A1 | 6/1980 | B22D/11/04 |
| JP | S60-045696 B | 7/1982 | C22C/9/04 |
| JP | 04 099140 | 7/1992 | |
| JP | 09 143596 | 10/1997 | |

OTHER PUBLICATIONS

Popa et al., New High–Temperature Copper Alloys, Journal of Materials Engineering and Performance, ASM International, vol. 5, No. 6, Dec. 1, 1996, pp. 695–698.

Database Compendex Online, Engineering Information, Inc., Popa et al., "Caracteristicile Sistemului Cu–Ni–Si, Functie de Compusul Ni2Si" (Abstract) & Cercet Metal 1977 Inst. de Cercet Metal, Bucharest, Romania, vol. 18, pp. 513–521.

* cited by examiner

*Primary Examiner*—S. Ip

(74) *Attorney, Agent, or Firm*—Ernest D. Buff and Associates, LLC; Ernest D. Buff; Gordon E. Fish

(57) ABSTRACT

A copper-nickel-silicon quench substrate rapidly solidifies molten alloy into microcrystalline or amorphous strip. The substrate is composed of a thermally conducting alloy. It has a two-phase microstructure with copper rich regions surrounded by a network of nickel silicide phases. The microstructure is substantially homogeneous. Casting of strip is accomplished with minimal surface degradation as a function of casting time. The quantity of material cast during each run is improved without the toxicity encountered with copper-beryllium substrates.

9 Claims, 5 Drawing Sheets

COPPER-NICKEL-SILICON TWO PHASE QUENCH SUBSTRATE

BACKGROUND OF THE INVENTION

1. Field of the Invention

This invention relates to manufacture of ribbon or wire by rapid quenching of a molten alloy, and more particularly to compositional and structural characteristics of a casting wheel substrate used to obtain the rapid quench.

2. Description of the Prior Art

Continuous casting of alloy strip is accomplished by depositing molten alloy onto a rotating casting wheel. Strip forms as the molten alloy stream is maintained and solidified through conduction of heat by the casting wheel's rapidly moving quench surface. The solidified strip departs the chill wheel and is handled by winding machinery. For continuous casting of high quality strips, this quenching surface must withstand thermally generated mechanical stresses due to the cyclic molten metal contact and removal of solidified strip from the casting surface. Any defect in the quenching surface is subject to penetration by the molten metal, whereupon the removal of solidified strip plucks away portions of the chill surface causing further degradation of the chill surface. As a result, the surface quality of the strips suffers as longer lengths of strips are cast within a given track on a chill wheel. The cast length of high quality strip provides a direct measure of the quality of the wheel material.

Key factors for improved performance of the quench surface are (i) use of alloys having high thermal conductivity, so that heat from the molten metal can be extracted to solidify the strip and (ii) use of materials with high mechanical strength to maintain the integrity of the casting surface, which is subjected to high stress levels at elevated temperature (>500 C). Alloys that have high thermal conductivity do not have high mechanical strength, especially at elevated temperatures. Therefore, thermal conductivity is compromised to use alloys with adequate strength characteristics. Pure copper has very good thermal conductivity, but shows severe wheel damage after casting short lengths of strip. Examples include copper alloys of various kinds and the like. Alternatively, various surfaces can be plated onto the casting wheel quench surface in order to improve its performance, as disclosed in European Patent No. EP0024506. A suitable casting procedure has been described in detail by U.S. Pat. No. 4,142,571, the disclosure of which is incorporated herein by reference.

Casting wheel quench surfaces of the prior art generally involve one of two forms: monolithic or multi-component. In the former, a solid block of alloy is fashioned into the form of a casting wheel that is optionally provided with cooling channels. Component quench surfaces comprise a plurality of pieces which, when assembled, constitute a casting wheel, as disclosed in U.S. Pat. No. 4,537,239. The casting wheel quench surface improvements of the present disclosure are applicable to all kinds of casting wheels.

Casting wheel quench surfaces have conventionally been made from a single-phase copper alloy or from a single-phase copper alloy with coherent or semi-coherent precipitates. The alloy is cast and mechanically worked in some manner prior to fabricating a wheel quench surface therefrom. Certain mechanical properties such as hardness, tensile and yield strength, and elongation have been considered, in combination with compromises to thermal conductivity. This has been done in an effort to achieve the best combination of mechanical strength and thermal conductivity properties possible for a given alloy. The reason for this is basically twofold: 1) to provide a quench rate which is high enough to result in the cast strip microstructure which is desired, 2) to resist quench surface thermal and mechanical damage which would result in degradation of strip geometric definition and thereby render the cast product unusable. Typical alloys exhibiting a single phase with coherent or semi-coherent precipitates include copper beryllium alloys of various compositions and copper chromium alloys with low concentrations of chromium. Both beryllium and chromium have very little solid solubility in copper.

The strip casting process is complicated and dynamic or cyclical mechanical properties need to be seriously considered in order to develop a quench surface that has superior performance characteristics. The processes by which the feedstock single-phase alloy for use as a quenching surface is made can significantly affect subsequent strip casting performance. This can be due to the amount of mechanical work and subsequent strengthening phases which occur after heat treatment. It can also be due to the directionality or the discrete nature of some mechanical working processes. For example, ring forging and extrusion both impart anisotropy of mechanical properties to a work piece. Unfortunately, the direction of this resulting orientation is not typically aligned along the most useful direction within the quench surface. The heat treatment employed to achieve alloy recrystallization and grain growth and strengthening coherent phase precipitation with the single phase alloy matrix is often insufficient to ameliorate the deficiencies induced during the mechanical working process steps. The resultant quench surface exhibits a microstructure having non-uniform grain size, shape, and distribution. Changes in the processing of these single phase copper alloys, which have been used to obtain uniform fine equiaxial grain structure are disclosed in U.S. Pat. Nos. 5,564,490 and 5,842,511. The fine grained homogenous single phase structure reduces formation of large pits in the casting wheel surface. These pits, in turn, create corresponding 'pips' in the strip surface that contacts the wheel during the casting process. Many of these precipitation hardenable single phase copper alloys contain beryllium as one of their components. The biological toxicity aspects of a beryllium containing alloy, which is constantly polished to improve the quality of the casting surface, poses a health risk. Accordingly, non-toxic alloys that exhibit good molten metal quenching properties without surface degradation have been long sought.

Copper-nickel-silicon alloys with other elemental additions have been used as a replacement for beryllium copper alloys in the electronic industry, as disclosed in U.S. Pat. No. 5,846,346. The precipitation of second phase is suppressed to provide high thermal conductivity and strength. Japanese patent publication number S60-45696 suggests adding 14 additives to produce very fine precipitates in certain Corson group alloys. These essentially single-phase alloys contain Cu with 0.5 to about 4 wt % Ni and 0.1 to about 1 wt % Si. Casting temperature capabilities for this essentially single-phase alloy are well below the requirements of a rapid-quench casting surface.

As a consequence remains a need in the art for non-toxic chill wheels for rapid solidification of molten alloy, which retain the surface quality of cast strips by resisting rapid deterioration during casting for a prolonged period of time. This need has heretofore not been met by existing essentially single-phase copper alloys even when the grain structure is well controlled.

SUMMARY OF THE INVENTION

The present invention provides an apparatus for continuous casting of alloy strip. Generally stated, the apparatus has a casting wheel comprising a rapidly moving quench surface that cools a molten alloy layer deposited thereon for rapid solidification into a continuous alloy strip. The quench surface is composed of a two-phase copper-nickel-silicon alloy having minor additions of other elements.

Generally stated, the alloy has a composition consisting essentially of about 6–8 wt % nickel, about 1–2 wt % silicon, about 0.3–0.8 wt % chromium, the balance being copper and incidental impurities. Such an alloy has a microstructure containing fine grains of the copper phase surrounded by thin well-bonded network regions of nickel silicide. Alloys having this microstructure are processed using certain alloy-manufacturing casting and mechanical working methods, and final heat treatment. The microstructure of the alloy is responsible for its high thermal conductivity and high hardness and strength. The thermal conductivity is derived from the copper phase and the hardness is derived from the nickel silicide phase. Distribution of the surrounding network phase creates a cell structure with cell size in the 1–250 $\mu$m range, presenting a substantially homogeneous quench surface to the molten melt. Such an alloy resists degradation during casting for a prolonged period of time. Long lengths of strips can be cast from such molten alloys without formation of surface projections known as 'pips', or other surface degradation.

Generally stated, the quench casting wheel substrate of the present invention is produced by a process comprising the steps of: (a) casting a copper-nickel-silicon two phase alloy billet having a composition consisting essentially of about 6–8 wt % nickel, about 1–2 wt % silicon, about 0.3–0.8 wt % chromium, the balance being copper and incidental impurities; (b) mechanically working said billet to form a quench casting wheel substrate; and (c) heat treating said substrate to obtain a two-phase microstructure having a cell size ranging from about 1–1000 $\mu$m.

Use of a two-phase crystalline quench substrate advantageously increases the service life of casting wheel. Run times for casts conducted on the quench surface are significantly lengthened, and the quantity of material cast during each run is improved without the toxicity encountered with copper-beryllium substrates. Strip cast on the quench surfaces exhibits far fewer surface defects, and hence, an increased pack factor (% lamination); the efficiencies of electrical power distribution transformers made from such strip are improved. Run response of the quench surface during casting is remarkably consistent from one cast to another, with the result that the run times of substantially the same duration are repeatable and scheduling of maintenance is facilitated. Advantageously, yields of strip rapidly solidified on such substrates are markedly improved, down time involved in maintenance of the substrates is minimized, and the reliability of the process is increased.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENT

Figure 1:
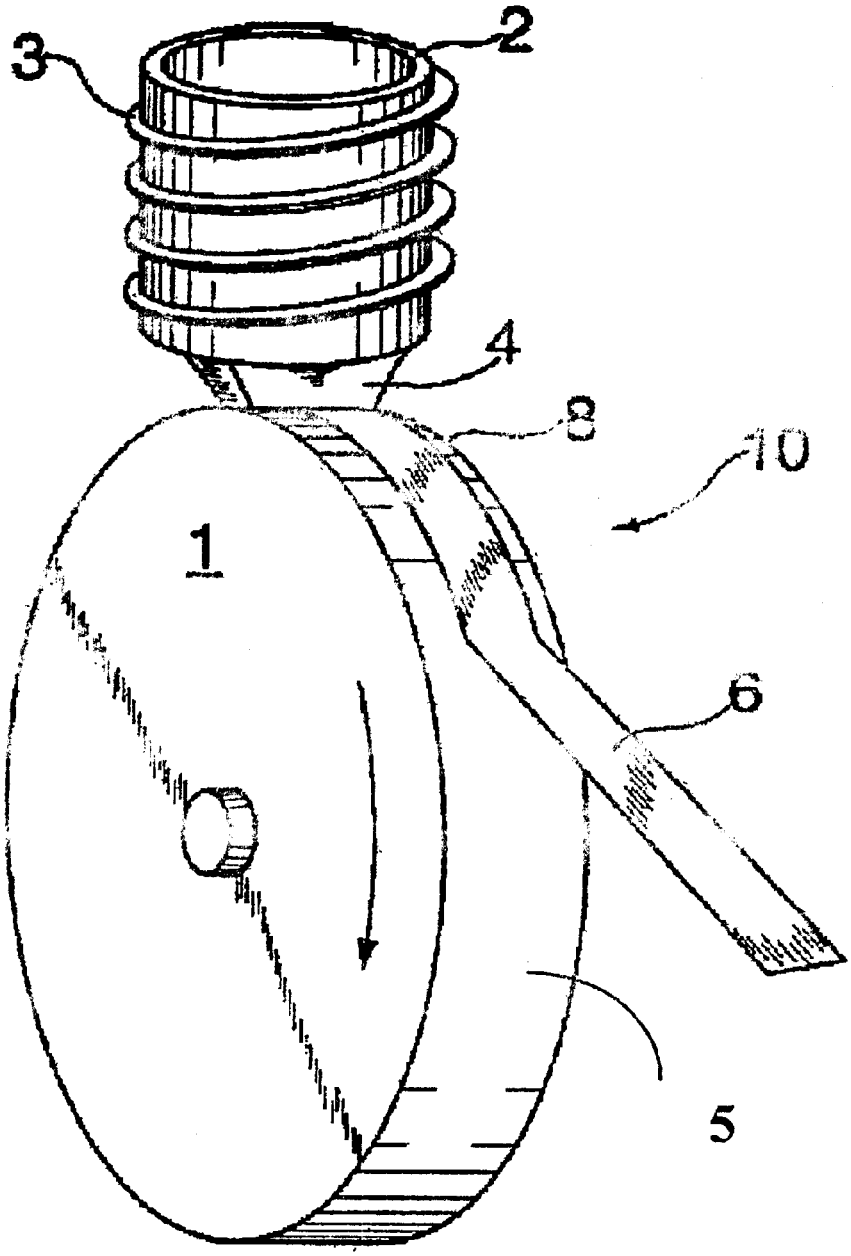
FIG. 1 is a perspective view of an apparatus for continuous casting of metallic strip.

As used herein, the term "amorphous metallic alloys" means a metallic alloy that substantially lacks any long range order and is characterized by X-ray diffraction intensity maxima which are qualitatively similar to those observed for liquids or inorganic oxide glasses.

The term two phase alloy with a structure, as used herein, means an alloy that has copper rich regions surrounded by a network of nickel silicide to produce a cell structure having a size less than 250 $\mu$m (0.010 in).

As used herein, the term "strip" means a slender body, the transverse dimensions of which are much smaller than its length. Strip thus includes wire, ribbon, and sheet, all of regular or irregular cross-section.

The term "rapid solidification", as used herein throughout the specification and claims, refers to cooling of a melt at a rate of at least about $10^4$ to $10^{6°}$ C./s. A variety of rapid solidification techniques are available for fabricating strip within the scope of the present invention such as, for example, spray depositing onto a chilled substrate, jet casting, planar flow casting, etc.

As used herein, the term "wheel" means a body having a substantially circular cross section having a width (in the axial direction) which is smaller than its diameter. In contrast, a roller is generally understood to have a greater width than diameter.

By substantially homogeneous is herein meant that the quench surface of the two-phase alloy has a substantially uniform cell size in all directions. Preferably, a quench substrate that is substantially homogeneous has a constituent cell size uniformity characterized by at least about 80% of the cells having a size greater than 1 $\mu$m and less than 250 $\mu$m and the balance being greater than 250 $\mu$m and less than 1000 $\mu$m.

The term "thermally conducting", as used herein, means that the quench substrate has a thermal conductivity value greater than 40 W/m K and less than about 400 W/m K, and more preferably greater than 80 W/m K and less than about 400 W/m K, and most preferably greater than 100 W/m K and less than 175 W/m K.

In this specification and in the appended claims, the apparatus is described with reference to the section of a casting wheel which is located at the wheel's periphery and serves as a quench substrate. It will be appreciated that the principles of the invention are applicable, as well, to quench substrate configurations such as a belt, having shape and structure different from those of a wheel, or to casting wheel configurations in which the section that serves as a quench substrate is located on the face of the wheel or another portion of the wheel other than the wheel's periphery.

The present invention provides a two-phase copper-nickel-silicon alloy of particular microstructure for use as a quench substrate in the rapid quenching of molten metal. In a preferred embodiment of the alloy, the ratio of the alloying elements nickel, silicon with small additions of chromium is identified. Generally stated, the thermally conducting alloy is a copper-nickel silicon alloy consisting essentially of about 6–8 wt % nickel, about 1–2 wt % silicon, about 0.3–0.8 wt % chromium, the balance being copper and incidental impurities. Preferably, the thermally conducting alloy is a copper-nickel silicon alloy consisting essentially of about 7 wt % nickel, about 1.6 wt. % silicon, about 0.4 wt % chromium, the balance being copper and incidental impurities. The purity of all materials is that found in standard commercial practice.

Rapid and uniform quenching of metallic strip is accomplished by providing a flow of coolant fluid through axial conduits lying near the quench substrate. Also, large thermal cycling stresses result because of the periodic deposition of molten alloy onto the quenching substrate as the wheel rotates during casting. This results in a large radial thermal gradient near the substrate surface.

To prevent the mechanical degradation of the quench substrate which would otherwise result from this large thermal gradient and thermal fatigue cycling, the two phase substrate is comprised of fine, uniform-sized constituent cells which encapsulate the copper rich phase with the network of nickel silicide. This fine two phased cellular structure of the quench surface prevents removal of substrate cells by the solidified strip which leaves at high velocity from the quench surface. This surface integrity prevents the development of pits in the wheel, which replicate in the strip forming 'pips' or protrusions. These pips prevent the ability to laminate strips to produce a laminate reducing the stacking factor of strips.

The apparatus and methods suitable for forming polycrystalline strip of aluminum, tin, copper, iron, steel, stainless steel and the like are disclosed in several U.S. Patents. Metallic alloys that, upon rapid cooling from the melt, form solid amorphous structures are preferred. These are well known to those skilled in the art. Examples of such alloys are disclosed in U.S. Pat. Nos. 3,427,154 and 3,981,722.

Referring to FIG. 1 there is shown generally at 10, an apparatus for continuous casting of metallic strip. Apparatus 10 has an annular casting wheel 1 rotatably mounted on its longitudinal axis, reservoir 2 for holding molten metal and induction heating coils 3. Reservoir 2 is in communication with slotted nozzle 4, which is mounted in proximity to the substrate 5 of annular casting wheel 1. Reservoir 2 is further equipped with means (not shown) for pressurizing the molten metal contained therein to effect expulsion thereof though nozzle 4. In operation, molten metal maintained under pressure in reservoir 2 is ejected through nozzle 4 onto the rapidly moving casting wheel substrate 5, whereon it solidifies to form strip 6. After solidification, strip 6 separates from the casting wheel and is flung away therefrom to be collected by a winder or other suitable collection device (not shown).

The material of which the casting wheel quench substrate 5 is comprised may be single phase copper or any other metal or alloy having relatively high thermal conductivity. This requirement is particularly applicable if it is desired to make amorphous or metastable strip. Preferred materials of constriction for substrate 5 include fine, uniform grain-sized precipitation hardening single phase copper alloys, such as chromium copper or beryllium copper, dispersion hardening alloys, and oxygen-free copper. If desired, the substrate 5 may be highly polished or chrome-plated or the like to obtain strips having smooth surface characteristics. To provide additional protection against erosion, corrosion or thermal fatigue, the surface of the casting wheel may be coated in the conventional way using a suitable resistant or high-melting coating. Typically, a ceramic coating or a coating of corrosion-resistant, high-melting temperature metal is applicable, provided that the wetability of the molten metal or alloy being cast on the chill surface is adequate.

Figure 2:
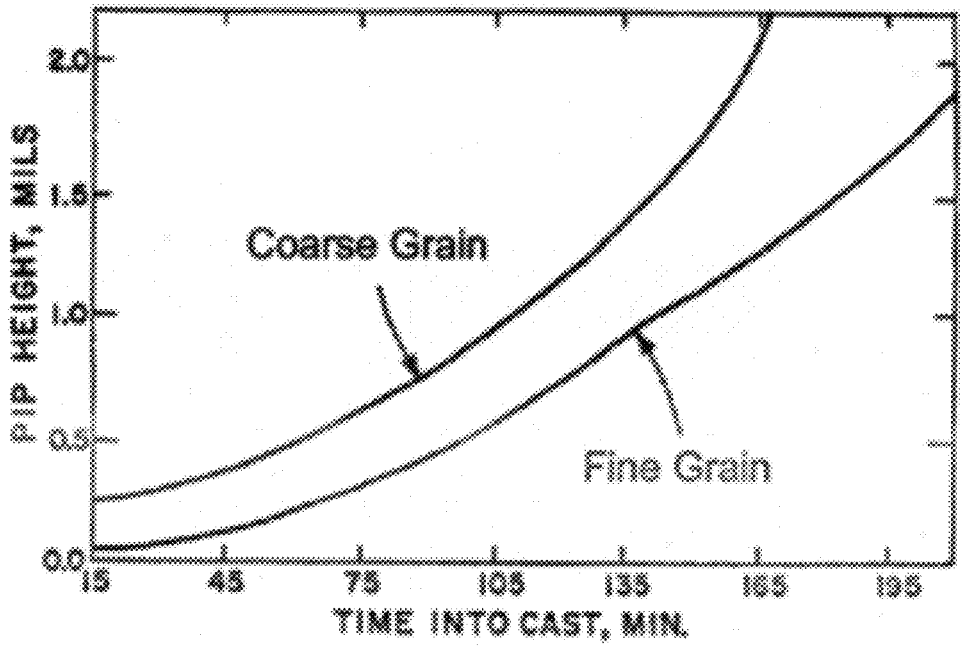
FIG. 2 is a graph showing performance degradation ("pipping") of a Cu 2 wt. % Be quench substrate with coherent or semi-coherent precipitates as a function of cast time, for continuous strip casting of 6.7 inch wide amorphous alloy strip.

As mentioned hereinabove, it is important that the grain size and distribution of the quench surface upon which molten metal or alloy is continuously cast into strip be both fine and uniform, respectively. A comparison of prior art single phase quench surfaces using two different grain sizes with respect to strip casting performance is shown by FIG. 2. Coarser grained precipitation hardened Cu-2% Be alloy degrades rapidly, due to the tearing action of the strip, which leaves with high velocity on the quench surface tearing large grains away and thereby producing pits. One mechanism by which degradation occurs under such circumstances involves the formation of very small cracks in the surface of the quench substrate. Subsequently deposited molten metal or alloy then enters these small cracks, solidifies therein, and gets pulled out, together with adjacent quench substrate materials, as the cast strip becomes separated from the quench substrate during the casting operation. The degradation process is degenerative, growing progressively worse with time into a cast. Cracked or pulled out spots on the quench substrate are called "pits", while the associated replicated protrusions, attached to the underside of the cast strip, are called "pips." On the other hand, a precipitation hardened single-phase copper alloy having a fine homogenous grain structure results in reduced degradation of the chill wheel quench surface, as disclosed by U.S. Pat. No. 5,564,490.

The quench substrate of the present invention is made by forming a melt containing a two phase alloy of copper-nickel-silicon with minor additions of chromium, and pouring the melt into a mold, thereby forming an ingot. The nickel silicide phase melts at 1325° C. and is not easily dissolved by molten copper, which melts at 1083° C. A recommended method for manufacturing the alloy involves use of copper-nickel master alloy with 30 to 50 wt % nickel and use of nickel-silicon master alloy with 28 to 35 wt % silicon. Both these alloys have melting points below or close to that of copper and can be easily dissolved without excessively superheating the copper melt. Super heating the copper melt has disadvantages since the incorporation of oxygen and hydrogen is greatly increased. Dissolution of oxygen reduces thermal conductivity while dissolution of hydrogen results in microporosity of the casting.

The as-cast ingot is impact-hammered repeatedly and thereby forged to disrupt the cast-in two-phase structure of the ingot and form a billet having a refined cell structure. The billet may be subjected to piercing by a mandrel to create a cylindrical body for further processing. The cylindrical body is cut into cylindrical lengths, which more nearly approach the shape of the final quench surface. In order to promote the uniformity of fine cell structure, the cylindrical lengths are subjected to a number of mechanical deformation processes. These processes include: (1) ring forging, in which the cylindrical length is supported by an anvil (saddle) and repeatedly pounded by a hammer, as the cylindrical length is gradually rotated about the anvil, thereby treating the entire circumference of the cylindrical length using discrete impact blows; (2) ring rolling, which is similar to ring forging, except that mechanical working of the cylindrical length is achieved in a much more uniform manner by the use of a set of rollers, rather than by a hammer; and (3) flow forming, in which a mandrel is used to define the inside diameter of the quench surface and a set of working tools act circumferentially around the cylindrical length while simultaneously being translated along the cylindrical length, thereby simultaneously thinning and elongating the cylindrical length while imparting extensive mechanical deformation.

In addition to the mechanical deformation processes described above, various heat treatment steps, carried out either between or during the mechanical deformation, may be utilized to facilitate processing and to produce a quench surface alloy having a well distributed fine cell structure wherein a two phase alloy with copper rich phase is surrounded by network of nickel silicide phases.

FIG. 2 is the performance data for beryllium copper alloys for a quench substrate with two different average grain sizes. Pips develop readily in the strips cast on a coarser gained substrate since casting of strips progressively damages the quench surface. Finer grained single-phase alloy degrades at a slower rate, permitting casting of longer strip lengths without pip formation.

Figure 3:
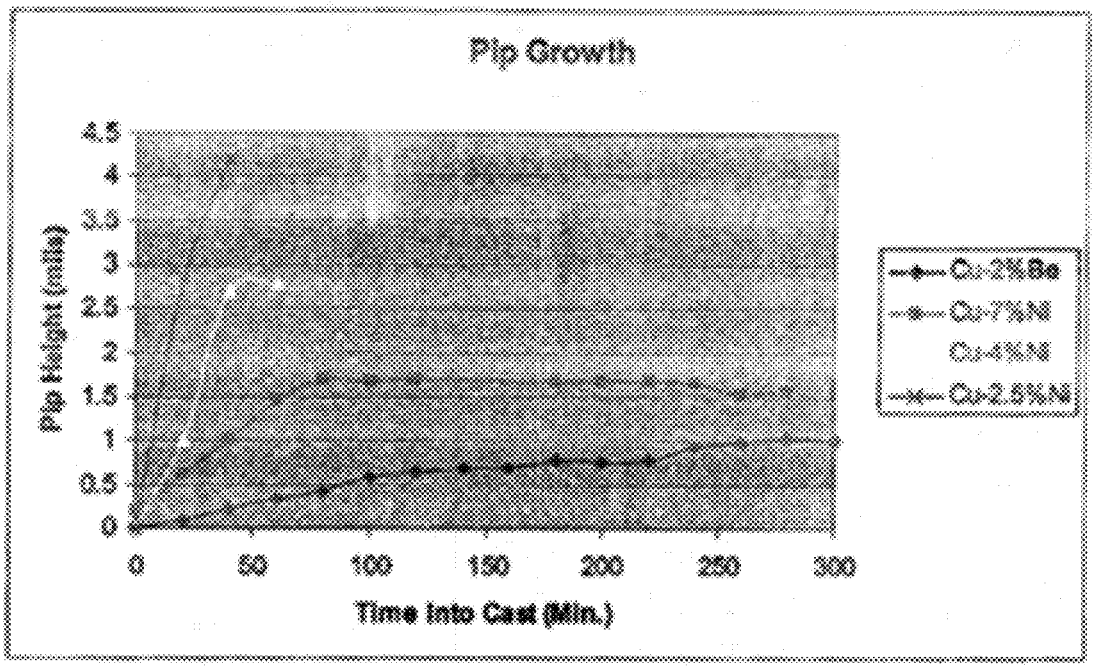
FIG. 3 is a graph showing performance degradation by pip growth as a function of time for Cu 2% Be, two phase Cu-7% Ni, designated composition 2 in Table I, and essentially single phase alloys Cu-4% Ni and Cu 2.5% Ni, designated compositions 3 and C18000 in Table I.

FIG. 3 is a graph showing performance degradation by pip growth as a function of time. The graph shows performance degradation by pip growth as a function of time for Cu 2% Be, two phase Cu-7% Ni, designated composition 2 in Table 1, and essentially single phase alloys Cu-4% Ni and CU 2.5% Ni, designated compositions 3 and C18000 in Table I. The 'pips' are a direct result of wheel pitting during casting of the strip on a single track. The data for two-phase copper-7% nickel-silicon alloy compares very well with that of the fine-grained single-phase precipitation hardened quenching substrate composed of the Cu-2 wt % Be alloy.

Figure 4:
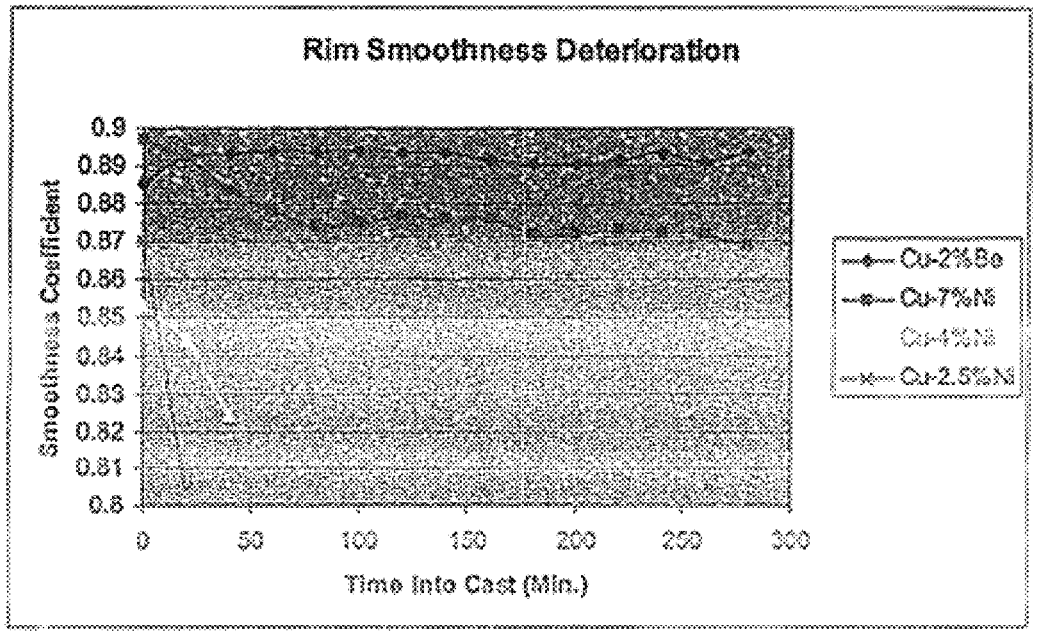
FIG. 4 is a graph showing performance degradation by rim smoothness degradation as a function of time for Cu 2% Be, two phase Cu-7% Ni, designated composition 2 in Table I, and essentially single phase alloys Cu-4% Ni and Cu 2.5% Ni, designated compositions 3 and C18000 in Table I.

FIG. 4 is a graph showing performance degradation by rim smoothness degradation as a function of time for Cu 2% Be, two phase CD-7% Ni, designated composition 2 in Table 1, and essentially single phase alloys Cu-4% Ni and Cu 2.5% Ni, designated compositions 3 and C18000 in Table I. The rim of the wheel is pitted due to the constant pulling away of the solidified strip cast on the quench surface. The data for two-phase copper-7% nickel-silicon alloy compares very well with that of the fine-grained single-phase precipitation hardened quenching substrate composed of the Cu-2 wt % Be alloy.

Figure 5:
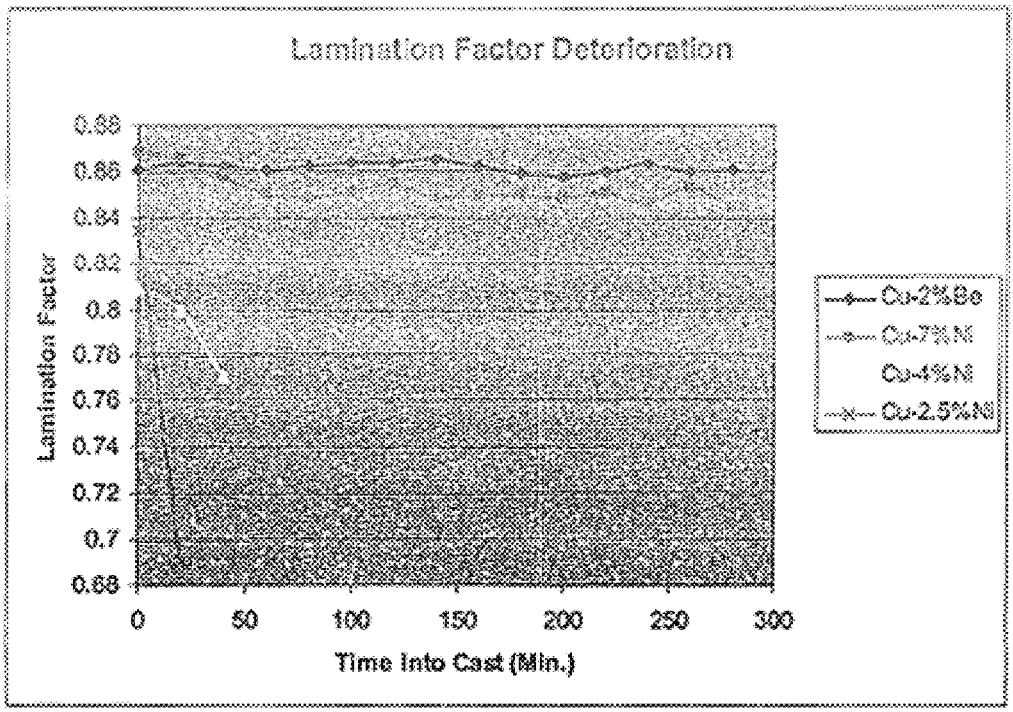
FIG. 5 is a graph showing performance degradation by lamination factor degradation as a function of time for Cu 2% Be, two phase Cu-7% Ni, designated composition 2 in Table I, and essentially single phase alloys Cu-4% Ni and Cu 2.5% Ni, designated compositions 3 and C18000 in Table I.

FIG. 5 is a graph showing performance degradation by lamination factor degradation as a function of time for Cu 2% Be, two phase Cu-7% Ni, designated composition 2 in Table 1, and essentially single phase alloys Cu-4% Ni and Cu 2.5% Ni, designated compositions 3 and C18000 in Table I. The 'pips' on the strips impede strip stackability, reducing the lamination factor. Lamination factor is convenient measured using the test method set forth in ASTM standard 900-91, standard Test Method for Lamination Factor of Amorphous Magnetic Strip, 1992 Annual Book of ASTM Standards, Vol. 03.04. The data for two-phase copper-7% nickel-silicon alloy compares very well with that of the fine-grained single-phase precipitation hardened quenching substrate composed of the Cu-2 wt % Be alloy.

Figure 6:
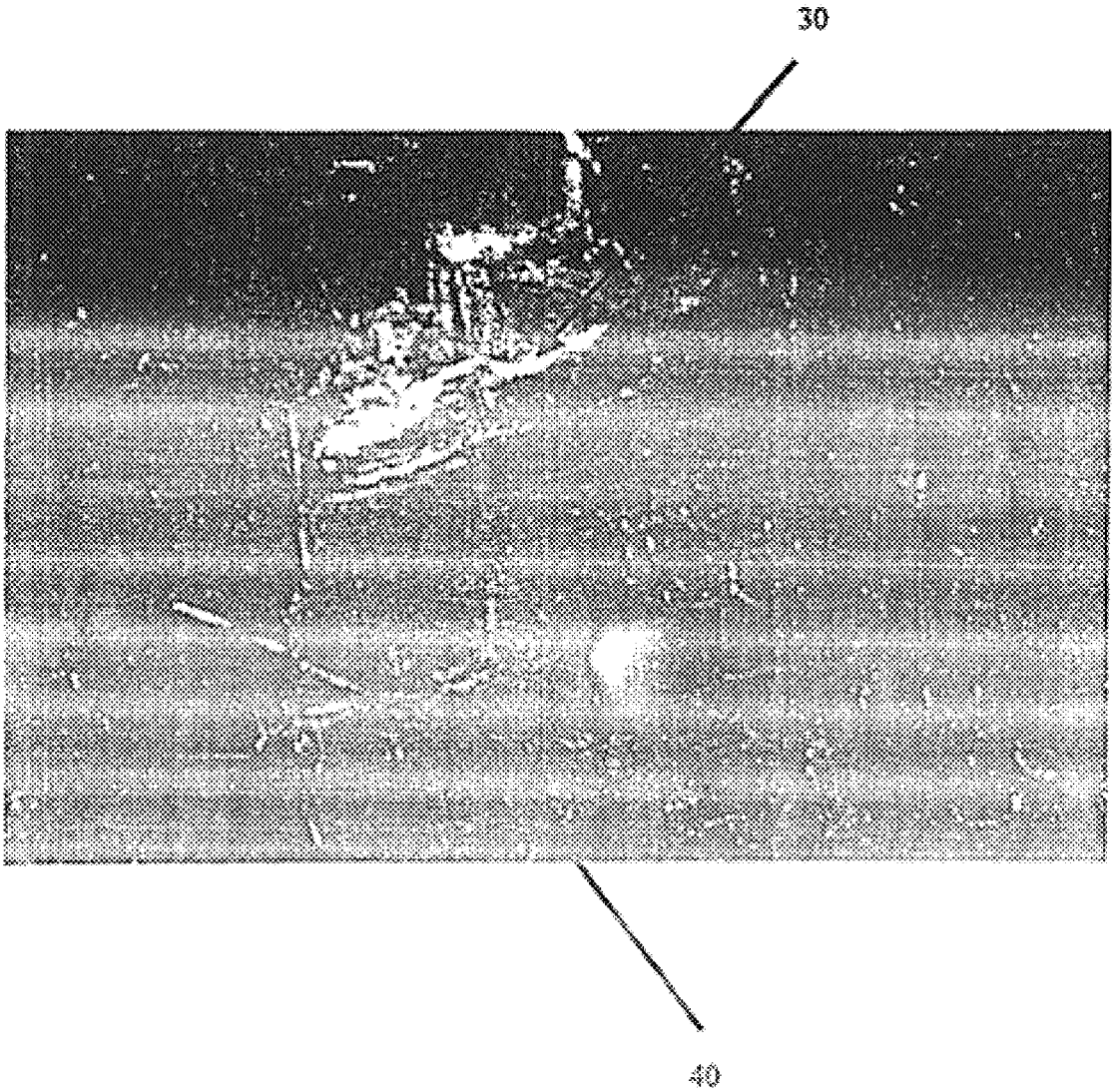
FIG. 6 is a photomicrograph of an essentially single phase alloy quench substrate designated composition C18000 in Table I after casting of strip for 21 minutes, showing pit formation.

In FIG. 6 there is shown the microstructure of a quench surface composed of alloy C18000, taken after a 21 minute cast of strip. Alloy C18000 is a single-phase alloy exhibiting homogenous fine grain distribution. The micrograph marker depicted has a length of 100 $\mu$m; the image is 1.4 mm (1400 $\mu$m) wide. Significant pit development is visible in the micrograph. Each pit, shown generally at 30, is depicted by the shiny area. Cracks, shown generally at 40, tend to develop into pits 30.

Figure 7:
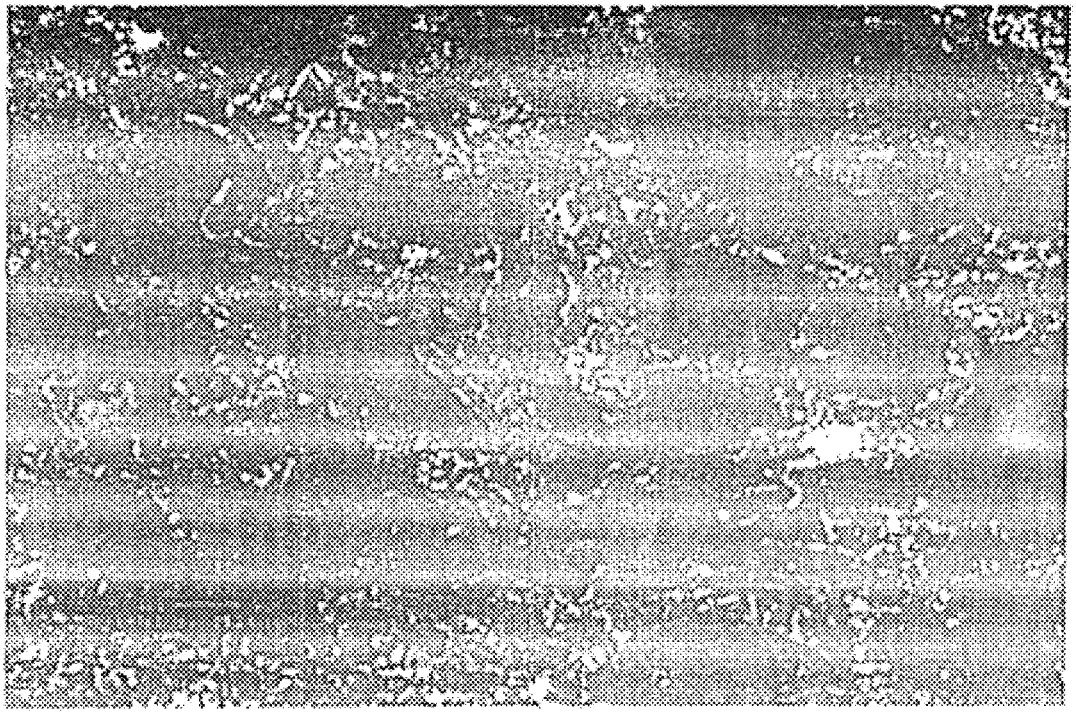
FIG. 7 is a photomicrograph of a copper-nickel-silicon two-phase quench substrate designated Alloy 2 in Table I, after casting of strip for 92 minutes, showing resistance to pit formation.

FIG. 7 is a micrograph of a two-phase alloy having the composition designated Alloy 2 in Table I, showing homogenous fine cell distribution after a 92-minute cast length. The micrograph marker depicted has a length of 100 $\mu$m; the image is 1.4 mm (1400 $\mu$m) wide. Shiny areas represent networks of secondary phase. No significant pit development is visible in the micrograph.

The copper-nickel-silicon alloy with minor additions of chromium does not contain hazardous elements like beryllium. OSHA limits for copper, nickel, silicon, chromium and beryllium in parts per million are listed under OSHA Limits for Air Contaminants 1910.1000 Table Z-1 and Z-2, and reproduced below:

OSHA LIMITS:

| Material | Element | $\mu$g/cubic meter |
|---|---|---|
| Copper Dust | (Cu) | 1000 |
| Nickel Metal and Compounds | (Ni) | 1000 |
| Silicon Respirable Dust | (Si) | 5000 |
| Chromium Metal and Compounds | (Cr) | 1000 |
| Beryllium and Compounds | (Be) | 2 |

These limits indicate the high toxic hazard of beryllium.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES

Five alloys of copper nickel and silicon were selected for study and are shown as alloys number 1, 2, 3, C18000 and C18200 in Table I. The composition of each of these alloys is set forth below in Table I.

TABLE I

| | Alloy Composition | | | | | |
|---|---|---|---|---|---|---|
| Alloy No. | Cu | Ni | Si | Cr | Fe | Mn |
| 1 | Balance | 7.00% | 1.60% | 0.40% | <0.1% | |
| 2 | Balance | 7.10% | 1.70% | 0.70% | 0.05% | |
| 3 | Balance | 4.00% | 1.10% | 0.00% | 0.10% | 0.01% |
| C18000 | Balance | 2.50% | 0.60% | 0.50% | 0.20% | |
| C18200 | Balance | 0.00% | 0.10% | 0.90% | 0.10% | |

Alloys 1 and 2, having a fine cell structure of 5–250 $\mu$m, perform exceptionally well. They are two-phase alloys with copper rich regions surrounded by network nickel silicide phase. The performance of quench substrate alloy 2 is comparable to that of Cu-2 wt % Be alloy, as shown in FIGS.

3 through 5. Alloy 3 is a single-phase copper-nickel-silicon alloy, and wears down rapidly with less than 12% durability. It forms 'pits', readily degrading the quench surface. C18000 is a single-phase alloy similar to alloy 3, and degrades even more than alloy 3 due to lower nickel and silicon content. It shows degradation within 6% of the cast time for alloy 2. C18200 has no nickel and is the worst performer in the series, exhibiting quench surface degradation within less than 2% of the cast time for alloy 2.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A copper-nickel-silicon quench substrate for rapid solidification of molten alloy into strip, having a two-phase microstructure with copper rich regions surrounded by a network of nickel silicide phases, said quench substrate being composed of a thermally conducting alloy and said structure being substantially homogeneous, said thermally conducting alloy being a copper-nickel-silicon alloy consisting essentially of about 6–8 wt % nickel, about 1–2 wt % silicon, about 0.3–0.8 wt % chromium, the balance being copper and incidental impurities, and wherein the cell size of the two-phase structure ranges from 1–1000 μm, and said copper rich region is surrounded intimately by a network of nickel silicide.

2. A quench substrate as recited in claim 1, wherein the cell structure of the two-phase structure ranges from 1–250 μm.

3. A quench substrate as recited in claim 1, wherein said thermally conducting alloy is a copper-nickel-silicon alloy consisting essentially of about 7 wt % nickel, about 1.6 wt % silicon, about 0.4 wt % chromium, the balance being copper and incidental impurities.

4. A process for forming a quench casting wheel substrate comprising the steps of:

a. casting a copper-nickel-silicon two phase alloy billet having a composition consisting essentially of about 6–8 wt % nickel, about 1–2 wt % silicon, about 0.3–0.8 wt % chromium, the balance being copper and incidental impurities;

b. mechanically working said billet to form a quench casting wheel substrate; and c. heat treating said substrate to obtain a two-phase microstructure having a cell size ranging from about 1–1000 μm.

5. A process as recited by claim 4 wherein said thermally conducting alloy is a copper-nickel-silicon alloy consisting essentially of about 7 wt % nickel, about 1.6 wt % silicon, about 0.4 wt % chromium, the balance being copper and incidental impurities.

6. A process as recited by claim 4, wherein the cell structure of the two-phase structure ranges from 1–250 μm, and said copper rich region is surrounded intimately by a network of nickel silicide.

7. A process as recited by claim 4, wherein said mechanical working step includes the step of extruding said billet.

8. A process as recited by claim 4, wherein said mechanical working step includes the step of ring rolling said billet.

9. A process as recited by claim 4 wherein said mechanical working step includes the step of saddle forging said billet.

* * * * *